US008277134B2

(12) United States Patent
Kawaguchi

(10) Patent No.: US 8,277,134 B2
(45) Date of Patent: Oct. 2, 2012

(54) PRINTER WITH CUTTER

(75) Inventor: Kouji Kawaguchi, Chiba (JP)

(73) Assignee: Seiko Instruments Inc. (JP)

( * ) Notice: Subject to any disclaimer, the term of this patent is extended or adjusted under 35 U.S.C. 154(b) by 591 days.

(21) Appl. No.: 12/387,940

(22) Filed: May 7, 2009

(65) Prior Publication Data

US 2009/0279935 A1 Nov. 12, 2009

(30) Foreign Application Priority Data

May 8, 2008 (JP) ..... 2008-122674

(51) Int. Cl.
*B41J 15/00* (2006.01)

(52) U.S. Cl. ..... 400/621

(58) Field of Classification Search ..... 400/621
See application file for complete search history.

(56) References Cited

U.S. PATENT DOCUMENTS

2001/0000463 A1* 4/2001 Kaya ..... 400/621
2003/0198499 A1* 10/2003 Tsuchiya et al. ..... 400/621

FOREIGN PATENT DOCUMENTS

EP 1391408 3/2004
EP 1900535 3/2008

* cited by examiner

*Primary Examiner* — Michael G Lee
*Assistant Examiner* — Matthew Mikels
(74) *Attorney, Agent, or Firm* — Adams & Wilks

(57) ABSTRACT

A printer with a cutter has a print head, a a platen roller, a fixed blade, and a movable blade that slides toward the fixed blade for cutting a printed recording sheet. A fixed blade holder has a first surface supporting the fixed blade thereon and a second surface curved along an outer periphery of the platen roller with a first gap therebetween for guiding the recording sheet toward a downstream side of the fixed blade holder when the recording sheet enters the first gap. A holder support pivotally supports the fixed blade holder and has a surface opposed to the outer periphery of the platen roller with a second gap therebetween for guiding the recording sheet to allow the recording sheet to be wound around the outer periphery of the platen roller when the recording sheet is guided by the second surface of the fixed blade holder.

20 Claims, 13 Drawing Sheets

PRINTER WITH CUTTER

BACKGROUND OF THE INVENTION

1. Field of the Invention

The present invention relates to a printer with a cutter capable of appropriately cutting a recording sheet pulled out from a paper roll after performing printing on the recording sheet.

2. Description of the Related Art

Nowadays, a great number of various types of thermal printers, which perform printing by pressing a heated thermal head against a special recording sheet that changes color when heat is applied thereto, are provided. In particular, use is suitably made in printing of various labels, receipts, tickets, and the like because smooth character printing and colorful graphic printing are possible without using toner, ink, and the like.

As the thermal printers, printers provided with a cutter mechanism for cutting the printed recording sheet are typically known (see Patent Documents JP 2007-38367 A and JP 11-123692 A). The cutter mechanism is normally set (auto cutter) to automatically cut the recording sheet when printing is terminated, and hence can be immediately used for a receipt, a ticket, and the like, as mentioned above.

Now, an example of the thermal printer is briefly described with reference to the drawings.

As illustrated in FIG. 15, a thermal printer 100 mainly includes a print unit 101, a fixed blade unit 102, and a movable blade unit 103.

The print unit 101 includes a platen roller 110 for feeding a recording sheet P pulled out from a paper roll R housed within a housing section (not shown), and a thermal head 111 provided to be opposed to the platen roller 110, which prints various information on the recording sheet P. The platen roller 110 is rotatably supported by a holder 112, and is rotationally driven by a motor (not shown). The thermal head 111 is pushed against an outer peripheral surface of the platen roller 110, and performs printing while interposing the recording sheet P with the platen roller 110.

The fixed blade unit 102 includes a fixed blade 116 rockable through a hinge portion 115, and a biasing portion 117 such as a coil spring, for biasing the fixed blade 116 in a push-up direction, and is arranged parallel to the print unit 101. The movable blade unit 103 includes a movable blade 120 and a slide portion 121 for sliding the movable blade 120, and is arranged to be opposed to the fixed blade unit 102 through the recording sheet P.

As illustrated in FIG. 16, any one of or both of the fixed blade 116 and the movable blade 120 is/are formed to be warped over a longitudinal direction (direction indicated by an arrow L). When the movable blade 120 is slid to be on an upper surface of the fixed blade 116, the fixed blade and the movable blade are brought not into surface contact but into point contact with each other. As a result, the recording sheet P can be smoothly cut with good sharpness.

An operation of the thermal printer 100 configured as described above is described.

First, as illustrated in FIG. 17, the platen roller 110 is rotated to feed the recording sheet P between the fixed blade 116 and the movable blade 120. At the same time, the thermal head 111 is operated to start printing on the recording sheet P. As a result, various information can be continuously printed on the recording sheet P. Next, upon termination of the printing, the platen roller 110 continues feeding the recording sheet P until a printed portion is beyond the movable blade 120. Then, when the printed portion is beyond the movable blade 120, the slide portion 121 slides the movable blade 120. As a result, the recording sheet P can be cut with the movable blade 120 and the fixed blade 116. At this time, the fixed blade 116 is pushed up by the biasing portion 117. Therefore, even when the movable blade 120 is slid to be on the upper surface of the fixed blade, no gap is generated between the fixed blade 116 and the movable blade 120. Thus, the recording sheet P can be smoothly cut.

However, the following problems still remain for the conventional thermal printer 100.

Specifically, in the conventional thermal printer 100, the fixed blade unit 102 and the movable blade unit 103 which function as a cutter are mounted to the print unit 101. Therefore, because the thermal printer is constituted by the combination of a plurality of units, there is no easy way to compactly configure the thermal printer. Accordingly, it is difficult to meet the need for a reduction in size.

Moreover, as illustrated in FIG. 17, a distance H between the center of the platen roller 110 and a cutting position with the fixed blade 116 and the movable blade 120 becomes inevitably large. Correspondingly, as illustrated in FIG. 18, the distance H from an end of the recording sheet P to the printed portion becomes large. Specifically, a cut piece of the recording sheet P has a large unprinted area (blank area). Therefore, the recording sheet P is needlessly long to be hard to handle as a ticket, a receipt, or the like. At the same time, the consumption of paper is accelerated to prevent the paper roll R from being efficiently used.

Further, the platen roller 110 is rotatably supported by the holder 112. During printing, the recording sheet P for some reason frequently enters into the gap between the holder 112 and the platen roller 110 (paper jam). In this case, as illustrated in FIG. 19, the recording sheet P entering into the gap is likely to be folded into several layers. Therefore, for a recovery operation of the recording sheet P, the printing is forced to be stopped. In particular, because the recording sheet P is folded into several layers, the recording sheet P cannot be easily removed. As a result, the recovery operation takes a long time. Moreover, even if the recording sheet P is successfully pulled out, the recording sheet is usually folded into an accordion shape. Therefore, the recording sheet cannot be reused and is wasted.

SUMMARY OF THE INVENTION

The present invention has been made in view of the circumstances described above, and an object of the present invention is to provide a printer with a cutter, which has a compact structure to allow for the reduction in size, which is capable of performing printing while eliminating an unprinted area as much as possible, and which allows for a recovery operation to be performed without wasting a recording sheet even if a paper jam occurs during a printing operation.

The present invention provides the following techniques to solve the problems in the conventional art described above.

A printer with a cutter according to the present invention, for cutting a recording sheet pulled out from a paper roll after performing printing on the recording sheet, includes: a print head extending in a width direction of the recording sheet; a platen roller having an outer peripheral surface contactable with the print head with the recording sheet being interposed therebetween, for being rotated to feed the recording sheet; a fixed blade provided adjacent to the platen roller so as to be opposed to the fed recording sheet; a movable blade slidably provided so as to be opposed to the fixed blade, for holding the recording sheet fed at a time of sliding with the fixed blade to cut the recording sheet; a fixed blade holder having a substantially plate-like shape provided between the fixed blade and the platen roller, the fixed blade holder having one surface for fixing the fixed blade thereon and another surface being opposed to the outer peripheral surface of the platen roller with a gap therebetween; a holder support having an opposed surface opposed to the outer peripheral surface of the platen roller on a downstream side of the fixed blade holder in a rotating direction of the platen roller with a gap therebetween, for rockably supporting the fixed blade holder to allow a blade edge side of the fixed blade to be moved in a direction substantially orthogonal to a sliding direction of the movable blade; and a biasing member provided between the fixed blade holder and the holder support, for biasing the fixed blade holder in a push-up manner, and is characterized in that wherein the another surface of the fixed blade holder is formed to be curved along the outer peripheral surface of the platen roller and guides the recording sheet toward the downstream side in the rotating direction of the platen roller when the recording sheet gets into the gap between the fixed blade holder and the platen roller.

In the printer with a cutter according to the present invention, when the platen roller is rotated, the recording sheet pulled out from the paper roll is fed while being interposed between the outer peripheral surface of the platen roller and the print head. Simultaneously, various characters and graphics can be clearly printed on the fed recording sheet by the print head. Thereafter, the recording sheet which is further fed by the platen roller passes between the fixed blade and the movable blade.

When the printing is terminated to cut the recording sheet, the movable blade opposed to the fixed blade is slid. Then, the movable blade moves onto the upper surface of the fixed blade in an overlapping manner. As a result, the recording sheet is held between the movable blade and the fixed blade to be cut. As a result, the recording sheet wound into the paper roll can be used as a receipt, a ticket, or the like.

The blade edge side of the fixed blade rocks in a direction substantially orthogonal to the sliding direction of the movable blade through the holder support. In addition, the fixed blade holder is biased by the biasing member to be constantly pushed up. Thus, when the movable blade moves onto the upper surface of the fixed blade by the sliding operation, the fixed blade comes into contact with the movable blade at an appropriate contact pressure. Therefore, for cutting the recording sheet, the fixed blade and the movable blade come into friction with each other at the contact pressure. As a result, the recording sheet can be cut with good sharpness.

In addition, the fixed blade is fixed by the fixed blade holder while being provided adjacent to the platen roller. Therefore, the cutting position for cutting the recording sheet can be brought as close as possible to the center of the platen roller. Therefore, printing can be performed while the unprinted area is eliminated as much as possible. Thus, a cut piece of the recording sheet is prevented from being unnecessarily long. Moreover, the consumption of paper can be kept down, thereby allowing for efficient use of the paper roll.

Moreover, the fixed blade holder and the fixed blade are provided in the vicinity of the platen roller as described above. In addition, similarly to the fixed blade holder, the holder support is also provided in the vicinity of the platen roller. Therefore, a configuration is such that the components are gathered to be provided as close as possible to the platen roller. Thus, in contrast to the conventional printer including the platen roller, the fixed blade, and the movable blade, each being constituted as a separate unit, the printer of the present invention can be compactly configured to allow for the reduction in size.

Further, even when the recording sheet being fed by the platen roller gets into the gap between the fixed blade holder and the platen roller during the printing for some reason, the another surface of the fixed blade holder is formed to be curved along the outer peripheral surface of the platen roller. Therefore, the recording sheet is smoothly guided along the another surface to automatically move toward the downstream side in the rotating direction without being jammed during the movement. Then, the moved recording sheet moves into the gap between the holder support and the platen roller.

As described above, because the direction of the recording sheet can be automatically changed, there is a low risk that the recording sheet is jammed during the movement to be folded into several layers or into an accordion shape, in contrast to the conventional cases. Therefore, even if the paper jam occurs, the recording sheet can be easily recovered simply by being pulled out. In addition, because the recording sheet can be pulled out in a good condition, the recording sheet can be reused, and therefore, is not wasted. As a result, excellent economic efficiency is provided.

Further, in the above-mentioned printer with a cutter according to the present invention, the printer with a cutter according to the present invention is characterized in that the opposed surface of the holder support is formed to be curved along the outer peripheral surface of the platen roller, and guides the recording sheet to allow the recording sheet to be wound around the platen roller when the recording sheet is guided from a fixed blade holder side.

In the printer with a cutter according to the present invention, similarly to the another surface of the fixed blade holder, the opposed surface of the holder support is formed to be curved along the outer peripheral surface of the platen roller. The opposed surface of the holder support guides the recording sheet to allow the recording sheet to be wound around the platen roller when the recording sheet is guided from the fixed blade holder side. Therefore, even when the paper jam occurs, the recording sheet can be automatically wound around the platen roller. Thus, the recording sheet is unlikely to be folded or wrinkled. As a result, the recording sheet can be recovered in a better condition in comparison with the case where the present invention is not applied.

Further, in the above-mentioned printer with a cutter according the present invention, the printer with a cutter according to the present invention is characterized in that the opposed surface of the holder support is curved at substantially the same curvature as that of the platen roller.

In the printer with a cutter according to the present invention, the opposed surface of the holder support is curved at substantially the same curvature as that of the platen roller. Therefore, the recording sheet can be more surely and easily wound around the platen roller. Accordingly, the recovery operation at the time of occurrence of the paper jam is more facilitated, while the recording sheet can be recovered with better quality in comparison with the case where the present invention is not applied.

Further, in the above-mentioned printer with a cutter according to the present invention, the printer with a cutter according to the present invention is characterized in that the gap between the another surface of the fixed blade holder and the outer peripheral surface of the platen roller when the fixed blade holder is pushed up by the biasing member is set larger than the gap between the opposed surface of the holder support and the outer peripheral surface of the platen roller.

In the printer with a cutter according to the present invention, when the recording sheet is wound around the platen roller to result in an increase in diameter, the gap between the opposed surface of the holder support and the outer peripheral surface of the platen roller is first eliminated thereby. Therefore, the platen roller is affected by the elimination of the gap to stop rotating. The gap between the another surface of the fixed blade holder and the outer peripheral surface of the platen roller when the fixed blade holder is pushed up by the biasing member is set larger than the gap between the opposed surface of the holder support and the outer peripheral surface of the platen roller, and hence the fixed blade holder is rockable by the amount of a difference between the two gaps. Specifically, even when the rotation of the platen roller is stopped due to the diameter excessively increased by the winding of the recording sheet, the blade edge side of the fixed blade can be still pressed down.

Therefore, the movable blade can perform slicing, thereby cutting the recording sheet with the fixed blade and the movable blade. Thus, even if the rotation of the platen roller is stopped, the recording sheet can be cut to perform a quick recovery operation. As described above, because the rocking operation of the fixed blade can be ensured, the reliability of the recovery operation can be enhanced.

Moreover, because an excessive contact pressure can be prevented from acting between the fixed blade and the movable blade at the time of cutting, inconvenience such as the blocked movement of the inter-meshing blades getting stuck or the damages thereof can be prevented from occurring.

Further, the printer with a cutter according to the present invention is characterized in that a guide table for receiving the recording sheet entering into the gap between the another surface of the fixed blade holder and the platen roller to guide the recording sheet toward the downstream side in the rotating direction of the platen roller is formed on the holder support to extend beyond a boundary with the fixed blade holder toward the another surface of the fixed blade holder.

In the printer with a cutter according to the present invention, when the recording sheet gets in between the fixed blade holder and the platen roller during the printing for some reason, the recording sheet is temporarily smoothly guided along the another surface to automatically start moving toward the downstream side in the rotating direction of the platen roller. Then, the recording sheet is transferred to the guide table while moving. Then, the transferred recording sheet is guided toward the downstream side in the rotating direction of the platen roller while moving on the guide table in a sliding manner to move into the gap between the opposed surface of the holder support and the platen roller. In particular, the guide table is formed to extend from the holder support beyond the boundary with the fixed blade holder toward the another surface of the fixed blade holder. Therefore, even if a level difference is generated at the boundary between the another surface of the fixed blade holder and the opposed surface of the holder support, the recording sheet can be moved toward the downstream side in the rotating direction of the platen roller without being affected by the level difference. Therefore, the recording sheet can be more smoothly moved and be prevented from being jammed due to the effects of the level difference.

The printer with a cutter according to the present invention has a compact structure allowing for a reduction in size, and in addition, is capable of performing a printing operation while eliminating the occurrence of an unprinted area as much as possible. Moreover, even when a paper jam occurs during printing, the recording sheet can be easily recovered without being wasted.

DETAILED DESCRIPTION OF THE PREFERRED EMBODIMENT

Hereinafter, the printer with a cutter according to a first embodiment of the present invention is described with reference to FIGS. 1 to 11. In this embodiment, a thermal printer is exemplified as one example of a printer with a cutter.

Figure 1:
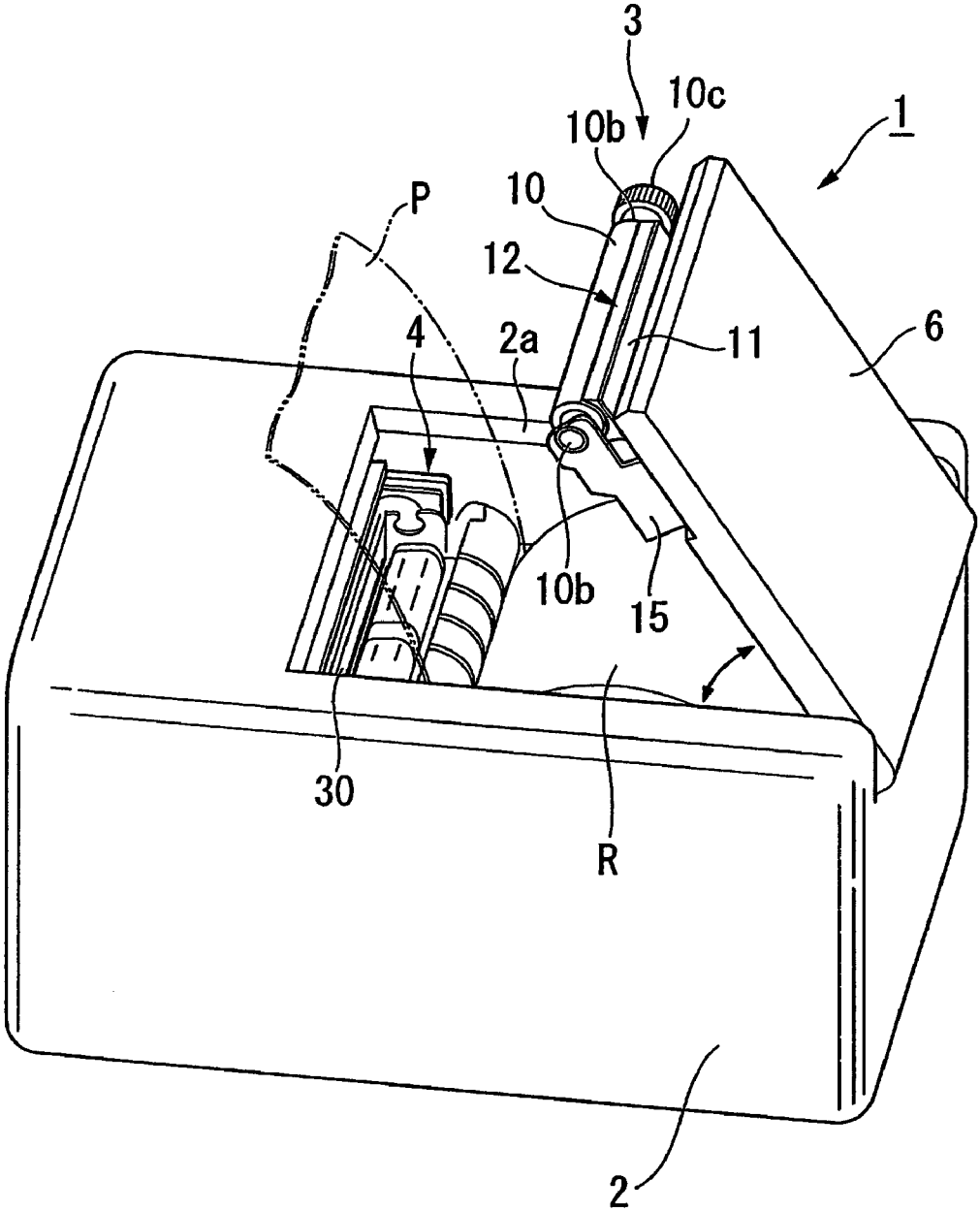
FIG. 1 is a perspective view of an outer appearance of a printer with a cutter according to a first embodiment of the present invention, illustrating a state where an opening/closing door is opened.
Figure 2:
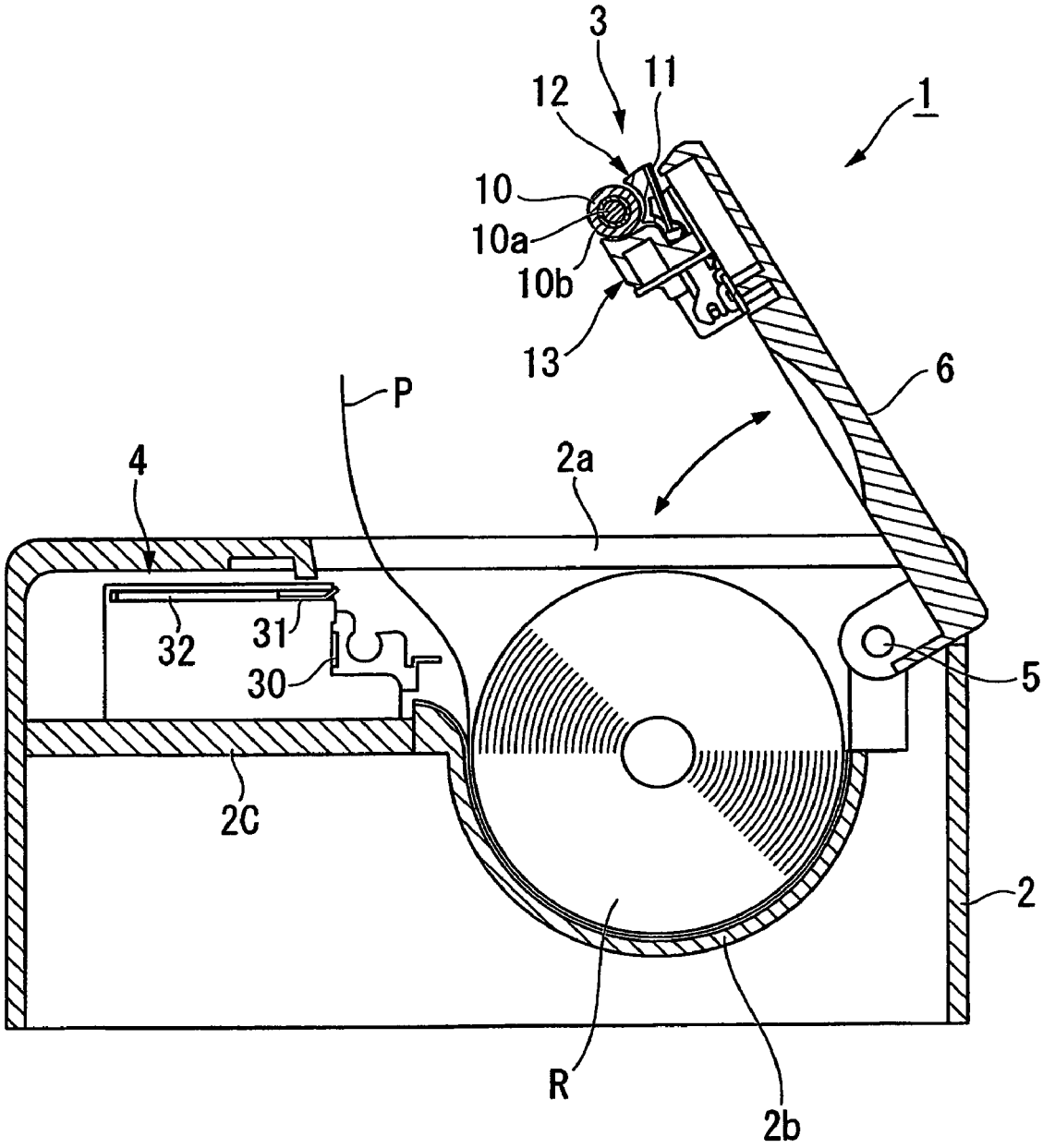
FIG. 2 is a sectional view of the printer with a cutter illustrated in FIG. 1.

A thermal printer 1 of this embodiment is a printer that can appropriately cut a recording sheet P pulled out from a paper roll R after performing printing on the recording sheet P to use as a ticket, a receipt, and the like, and mainly includes a casing 2, a platen unit 3, and a main body unit 4, as illustrated in FIG. 1 and FIG. 2.

The casing 2 is a casing molded from injection molding of plastic such as polycarbonate and the like or a metal material, and is formed to a box-shape with an insertion port 2*a* opened at the upper surface. A placement table 2*b* for placing the paper roll R inserted from the insertion port 2*a* is arranged in the interior of the casing 2. The placement table 2*b* is formed to be curved in an arcuate shape, and enables the cylindrical paper roll R to be stably mounted.

Further, an opening/closing door 6 connected in an openable/closable manner through an intermediation of a hinge portion 5 is attached to the upper surface of the casing 2. The opening/closing door 6 opens and closes within a range of a constant angle from an opened state illustrated in FIG. 2 to a closed state illustrated in FIG. 3. The insertion port 2*a* appears when the opening/closing door 6 is opened, and hence the paper roll R can be inserted into or be taken out from the casing 2. A slight gap is designed to be formed between the distal end of the opening/closing door 6 and the casing 2 when the opening/closing door 6 is closed. The recording sheet P is pulled out from the interior of the casing 2 utilizing such a gap. In other words, the gap functions as a discharge port 2*c* for the recording sheet P.

Note that the opening/closing door 6 automatically locks with respect to the casing 2 by a lock mechanism (not shown) when closed. The lock mechanism unlocks with one-touch from the outer side of the casing 2, and hence the opening/closing door 6 can be promptly opened.

The platen unit 3 is mounted onto an inner surface of the opening/closing door 6 on its distal end side and moves with the opening/closing door 6. The platen unit 3 mainly includes, as illustrated in FIGS. 4 to 6, a platen roller 10, a fixed blade 11, a fixed blade holder 12, and a fixed blade bracket (holder support) 13.

Figure 4:
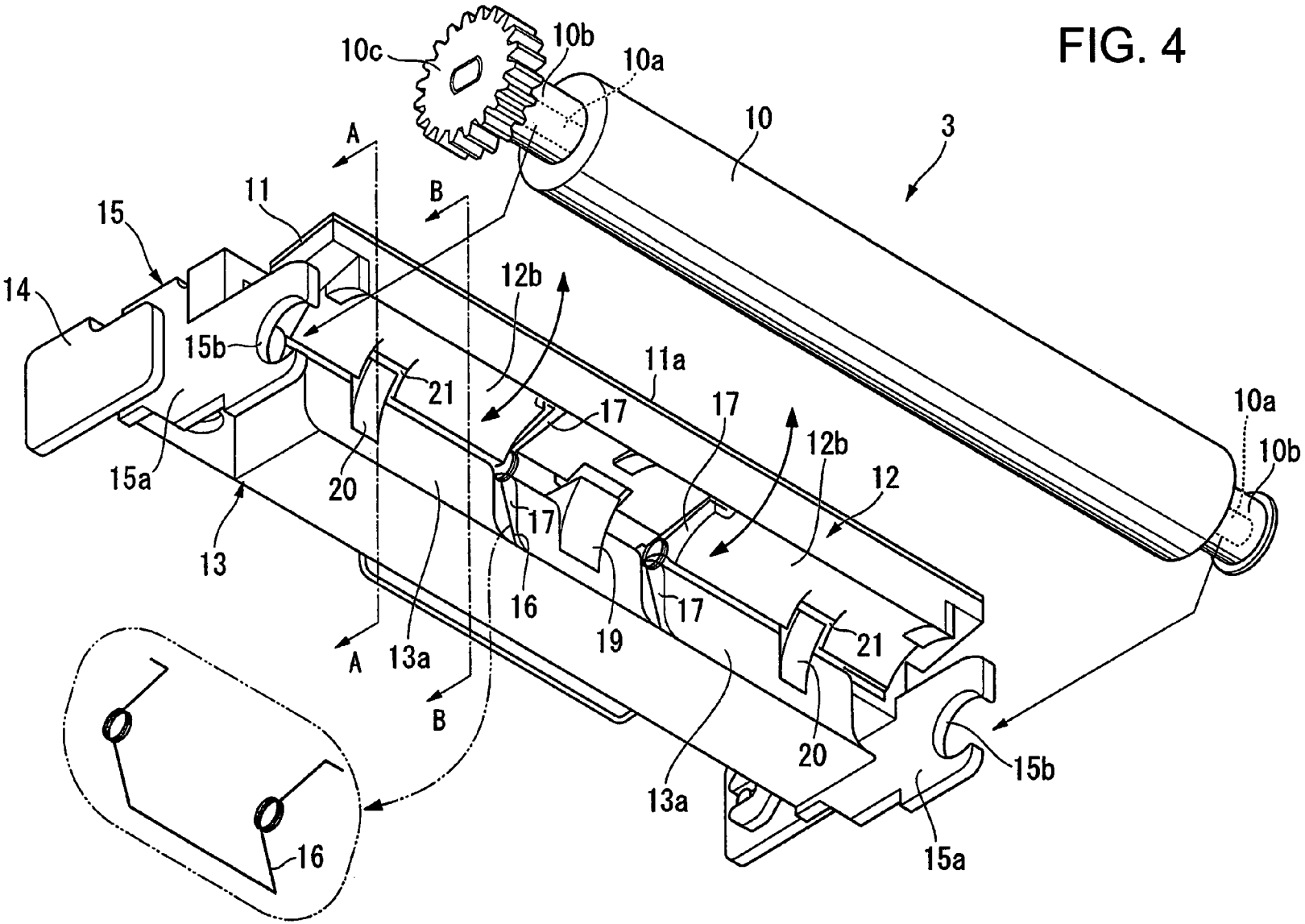
FIG. 4 is a perspective view of a platen unit constituting the printer with a cutter, illustrating a state where a platen roller is removed.
Figure 5:
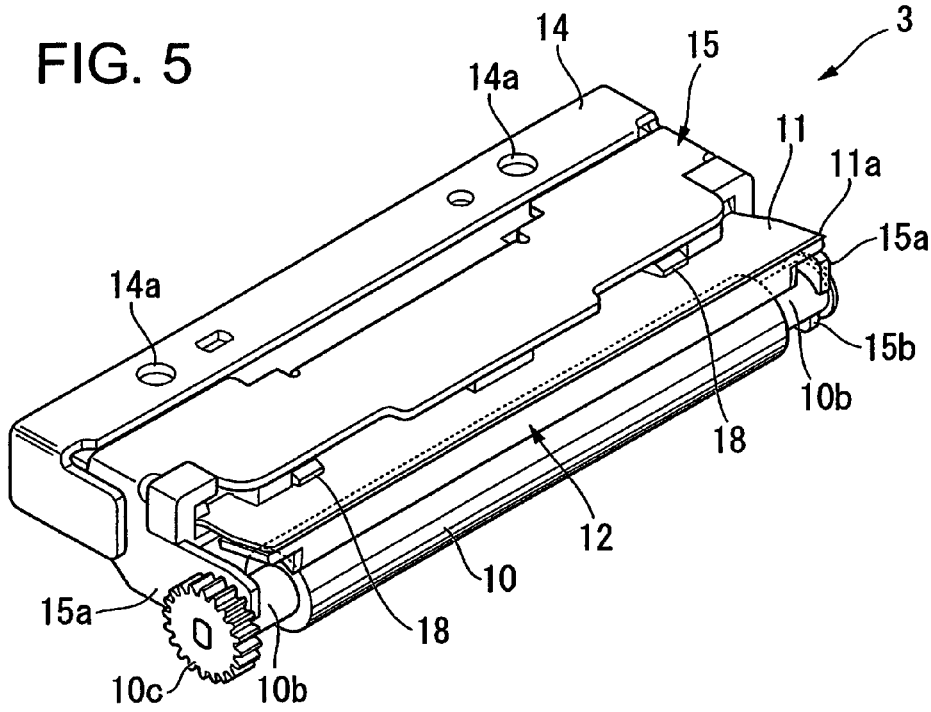
FIG. 5 is a perspective view of the platen unit illustrated in FIG. 4 when viewed from above, illustrating a state where the platen roller is mounted.
Figure 6:
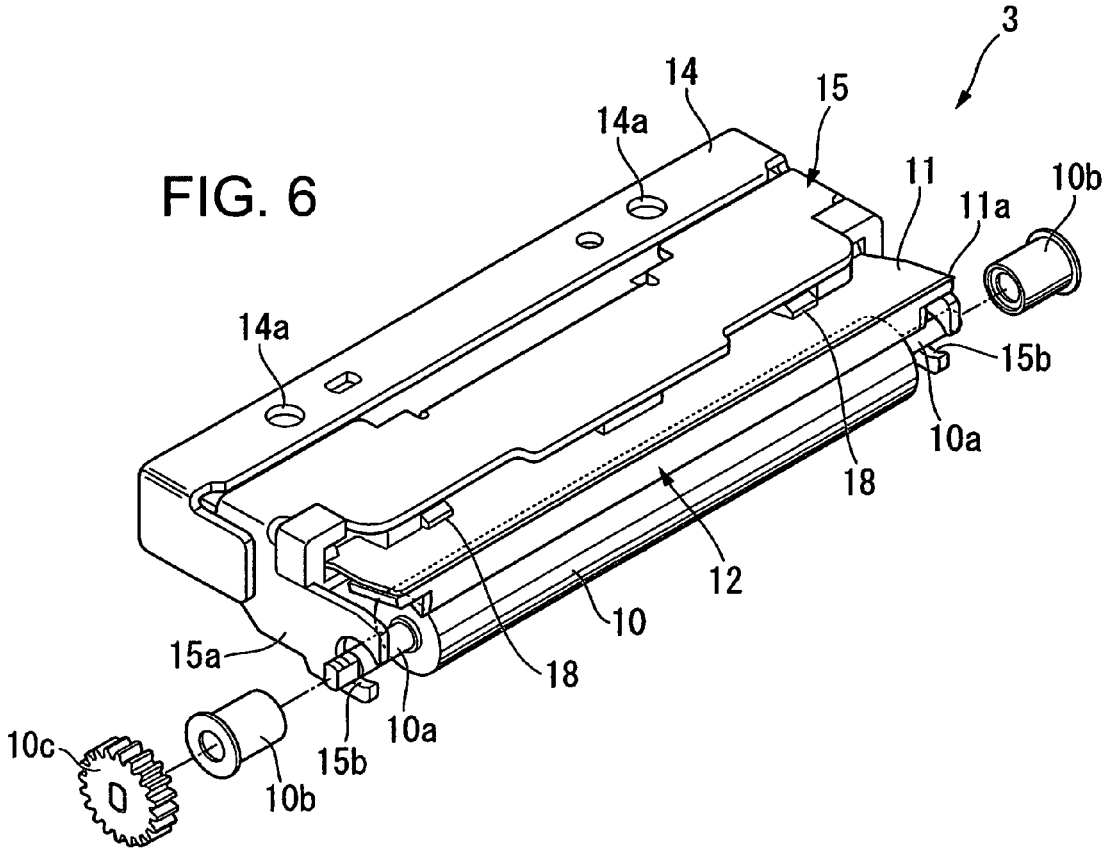
FIG. 6 is a view illustrating a state where some of components are disassembled in the state illustrated in FIG. 5.
Figure 7:
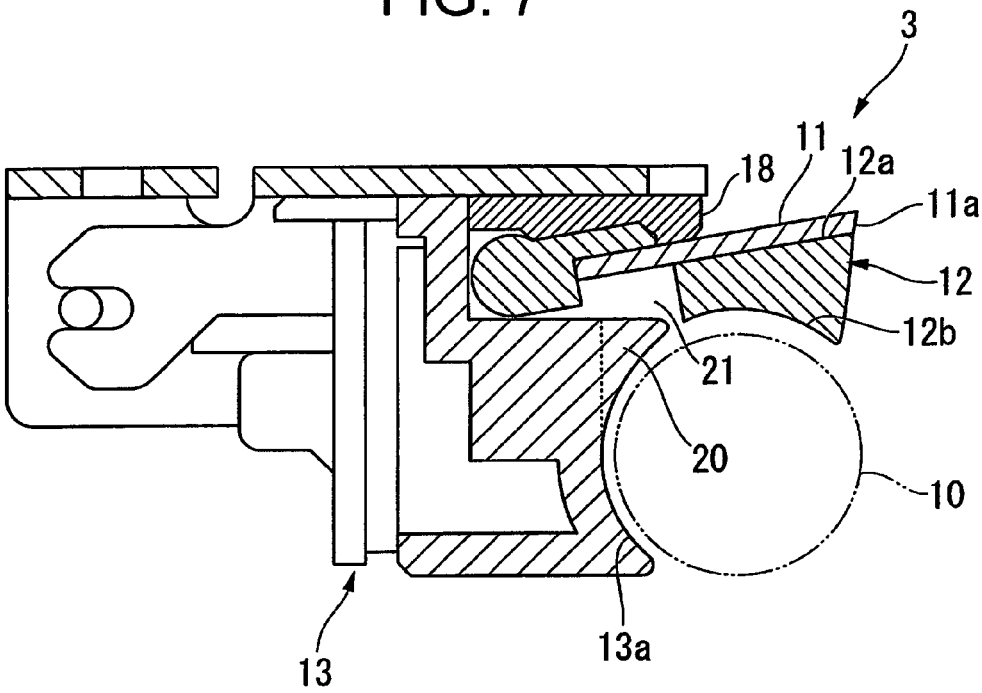
FIG. 7 is a sectional view taken along an arrow A-A of FIG. 4.
Figure 8:
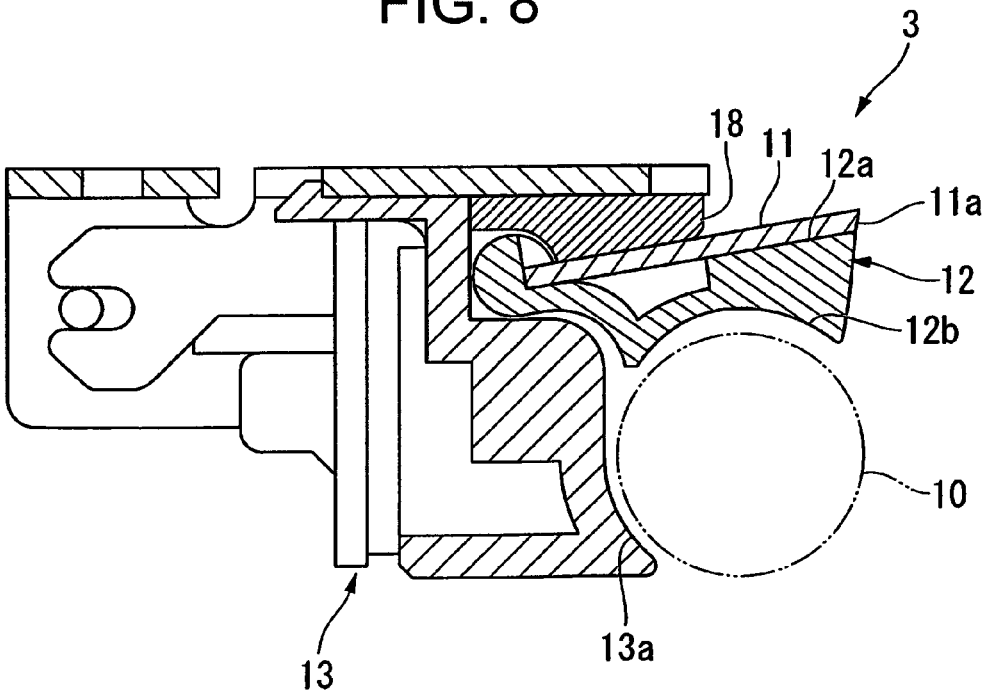
FIG. 8 is a sectional view taken along an arrow B-B of FIG. 4.

FIG. 4 is a view illustrating a state where the platen roller 10 is removed, which is viewed from below, FIG. 5 is a view illustrating a state where the platen roller 10 is mounted, which is viewed from above, and FIG. 6 is a view illustrating some of the components being disassembled for describing a supported state of the platen roller in the state illustrated in FIG. 5.

The platen roller 10 is rotatably supported by a platen frame 15 made of metal, which is fixed to the fixed blade bracket 13. For a detailed description, first, each shaft body 10*a* extending from each end of the platen roller 10 is covered with a cylindrical bearing 10*b* for rotatably supporting the shaft body 10*a*. As a result, even when the two bearings 10*b* are held down, the platen roller 10 can be rotated. At one end of the platen roller 10, a driven gear 10*c* is fixed in connection with the shaft body 10*a* through the bearing 10*b*.

The platen frame 15 is a plate bent into a U-shape. Bent plate end portions 15*a* are situated on both sides of the platen roller 10. A circular bearing hole 15*b* is formed through each of the two plate end portions 15*a*. The bearing 10*b* for rotatably supporting the shaft body 10*a* of the platen roller 10 is fitted into the bearing hole 15*b* to be fixed thereto. Specifically, the platen roller 10 is fixed to the platen frame 15 through the bearings 10*b*. Because the fixation is performed through the bearings 10*b*, the platen roller 10 is rotatable.

Figure 3:
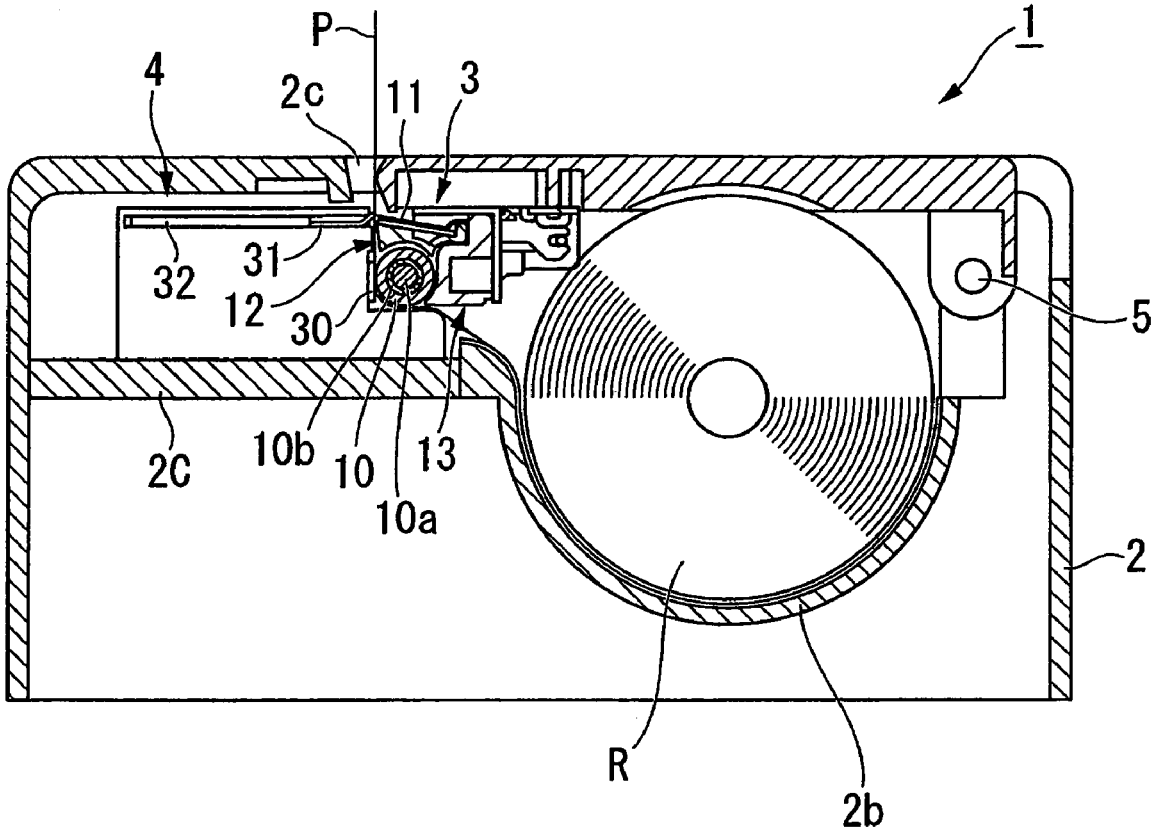
FIG. 3 is a view illustrating a state when the opening/closing door is closed from the state illustrated in FIG. 2.

In particular, the platen roller 10 is placed to cause its outer peripheral surface to come into contact with a thermal head (print head) 30 described below while interposing the recording sheet P pulled out from the paper roll R when the opening/closing door 6 is closed, as illustrated in FIG. 3.

When the opening/closing door 6 is closed, the driven gear 10*c* meshes with a gear transmission mechanism rotated by a motor. The motor and the gear transmission mechanism are provided in the main body unit 4. With this configuration, when the opening/closing door 6 is closed, the platen roller 10 is combined with the main body unit 4 to be rotated by a rotary driving force from the motor, and in addition, can feed the recording sheet P, which is pulled out from the paper roll R, upward from the casing 2 through the discharge port 2*c*.

The platen unit 3 is fixed to the opening/closing door 6 through a mounting plate 14 illustrated in FIGS. 5 and 6. The mounting plate 14 is a metallic plate bent into a U-shape, and is fixed to be slidable forward and backward (in a horizontal direction) with respect to the platen frame 15 by a certain amount. A plurality of spring holes 14*a* are formed through the mounting plate 14. The mounting plate is directly screwed onto the opening/closing door 6 by using the spring holes 14*a*. As a result, even when a support position of the opening/closing door 6 is slightly shifted from a designed position, a sliding structure between the mounting plate 14 and the platen frame 15 absorbs the shift to ensure the combination of the platen roller 10 with the main body unit 4. Specifically, the assembly has a certain degree of freedom.

The fixed blade 11 is a plate-like blade extending in a width direction of the recording sheet P, and is provided to be adjacent to the platen roller 10, as illustrated in FIGS. 4 to 8. More specifically, the fixed blade 11 is fixed to an upper surface (one of the surfaces) 12*a* of the fixed blade holder 12 provided between the fixed blade 11 and the platen roller 10. The fixed blade 11 is fixed to allow a blade edge 11*a* to be opposed to the fed recording sheet P when the opening/closing door 6 is closed.

The fixed blade holder 12 for fixing the fixed blade 11 is formed of plastic or the like into a substantially plate-like shape. A lower surface (other surface) 12*b* is opposed to the outer peripheral surface of the platen roller 10 with a gap therebetween. Proximal end side (side opposite to the blade edge 11*a* side of the fixed blade 11) of the fixed blade holder 12 has a circular shape. The proximal end side is fitted into the fixed blade bracket 13 to allow the fixed blade holder to be supported rockably with respect to the fixed blade bracket 13, with the fitting position as a point of support. As a result, the blade edge 11*a* side of the fixed blade 11 fixed to the fixed blade holder 12 is movable vertically (in a direction substantially orthogonal to the sliding direction of the movable blade 31).

The fixed blade bracket 13 is formed of plastic or the like to extend in the width direction of the recording sheet P, and is fixed to the inner side of the platen frame 15. The fixed blade bracket 13 rockably supports the fixed blade holder 12 as described above.

The fixed blade bracket 13 has an opposed surface 13*a* which is formed to be opposed to the outer peripheral surface of the platen roller 10 with a gap therebetween at the downstream of the fixed blade holder 12 in the rotating direction of the platen roller 10.

A torsion spring (biasing member) 16 for biasing the fixed blade holder 12 upward in a push-up manner (i.e., in a direction away from the peripheral surface of the platen roller) is provided between the fixed blade holder 12 and the fixed blade bracket 13. The torsion spring 16 is fitted into housing grooves 17 formed in substantially the center of a lower surface 12*b* of the fixed blade holder 12 and the opposed surface 13*a* of the fixed blade bracket 13, and constantly biases the fixed blade holder 12 to allow the blade edge 11*a* of the fixed blade 11 to be lifted up.

For the fixed blade bracket 13, an upper stopper 18 for restricting or limiting a movable amount of the fixed blade holder 12 in an upward direction and a lower stopper 19 for restricting a movable amount of the fixed blade holder 12 in a downward direction are formed.

The upper stopper 18 is formed to protrude from the bottom side of the fixed blade 11 toward the blade edge 11*a* immediately above the fixed blade 11 fixed to the fixed blade holder 12. As a result, when the fixed blade holder 12 is lifted up to some extent by the biasing of the torsion spring 16, the fixed blade 11 comes into contact with the upper stopper 18. Therefore, the further lift-up can be restricted.

On the other hand, the lower stopper 19 is formed in substantially the center of the opposed surface 13*a* of the fixed blade bracket 13. When the fixed blade holder 12 is pressed down, the lower stopper 19 comes into surface contact with the lower surface 12*b* to enable to restrict the further depression.

As described above, the upper stopper 18 and the lower stopper 19 define means for limiting a rocking angle of each of the fixed blade holder 12 and the fixed blade 11 within a certain range.

FIGS. 4 to 8 are views illustrating the state where the fixed blade holder 12 is biased upward by the torsion spring 16 to come into contact with the upper stopper 18.

The lower surface 12*b* of the fixed blade holder 12 and the opposed surface 13*a* of the fixed blade bracket 13 are now described in detail. First, the lower surface 12*b* of the fixed blade holder 12 is formed to be curved in an R-shape along the outer peripheral surface of the platen roller 10, and acts to automatically guide the recording sheet P toward the downstream side in the rotating direction of the platen roller 10 when the recording sheet P gets into the gap between the fixed blade holder 12 and the platen roller 10. A degree of the curve of the lower surface 12*b* is set to, for example, a curvature substantially equal to that of the outer peripheral surface of the platen roller 10 when the fixed blade holder 12 is pressed down toward the platen roller 10.

On the other hand, the opposed surface 13*a* of the fixed blade bracket 13 is also formed to be curved in an R-shape along the outer peripheral surface of the platen roller 10, and acts to guide the recording sheet P to allow the recording sheet P to be wound around the outer peripheral surface of the platen roller 10 when the recording sheet P is guided from the fixed blade holder 12 side. The opposed surface 13*a* of this embodiment is formed to be curved at the curvature substantially equal to that of the outer peripheral surface of the platen roller 10.

On the opposed surface 13*a* of the fixed blade bracket 13, two guide tables 20 extending beyond the boundary with the fixed blade holder 13 toward the lower surface 12*b* of the fixed blade holder 12 are formed. The two guide tables 20 are formed on both ends of the fixed blade bracket 13, and are fitted into concave portions 21 formed on the lower surface 12*b* of the fixed blade holder 12. Therefore, there is no level difference between the lower surface 12*b* of the fixed blade holder 12 and the surfaces of the guide tables 20, which is therefore in a flush state. Moreover, the surfaces of the guide tables 20 are curved at substantially the same curvature as that of the outer peripheral surface of the platen roller 10. Specifically, an area from the guide tables 20 to the opposed surface 13*a* of the fixed blade bracket 13 is smoothly curved at the same curvature.

The guide tables 20 actively receive the recording sheet P entering into the gap between the fixed blade holder 12 and the platen roller 10 to guide the recording sheet toward the downstream side in the rotating direction of the platen roller while sliding the recording sheet on their own surfaces.

The main body unit 4 is provided inside the casing 2 as illustrated in FIGS. 1 to 3, and is fixed onto an inner plate 2C formed integrally with the placement table 2*b*. The main body unit 4 mainly includes a thermal head 30 and the movable blade 31.

The thermal head 30 is formed to extend in the width direction of the recording sheet P and is provided at the position opposed to the platen roller 10 when the opening/closing door 6 is closed. The thermal head 30 includes a large number of heater elements (not shown), and is biased by a coil spring or the like (not shown) toward the platen roller 10. As a result, it is ensured that the thermal head 30 is pressed against the recording sheet P fed by the platen roller 10, thereby enabling good printing.

The movable blade 31 functions as a cutter in cooperation with the fixed blade 11, and is provided at the position opposed to the fixed blade 11 when the opening/closing door 6 is closed. By a slide portion 32 provided on its bottom side, the movable blade is slidable toward the fixed blade 11.

Figure 9:
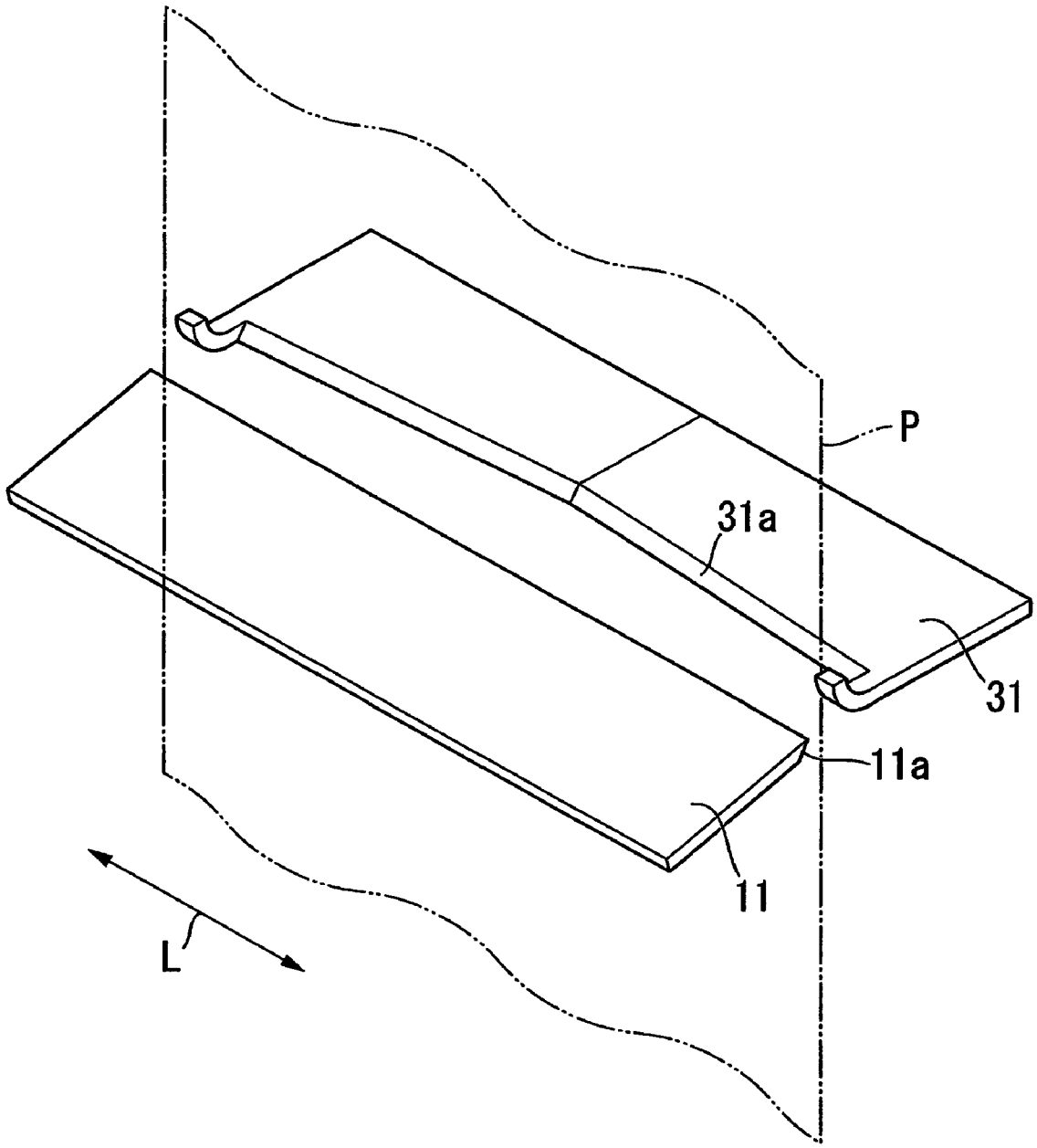
FIG. 9 is a view illustrating a positional relation between a fixed blade and a movable blade during printing.
Figure 10:
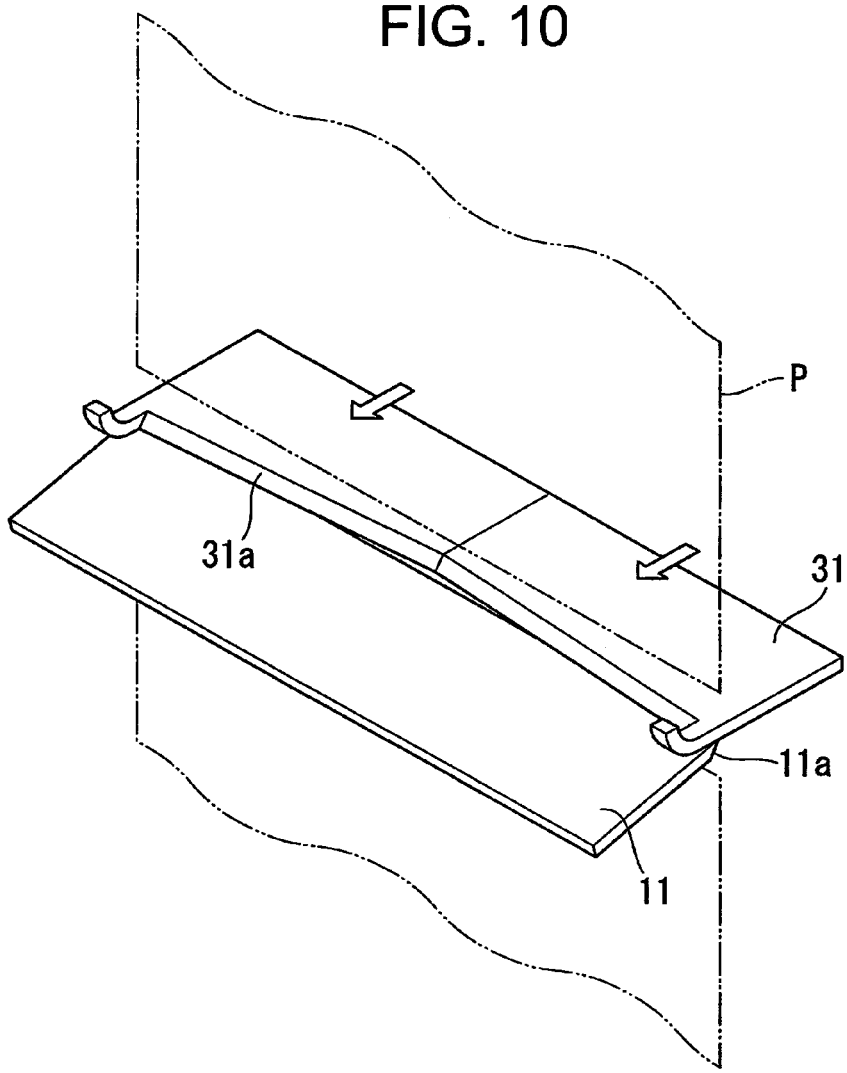
FIG. 10 is a view illustrating a state where the movable blade is slid from the state illustrated in FIG. 9 to cut a recording sheet between the fixed blade and the movable blade.
Figure 11:
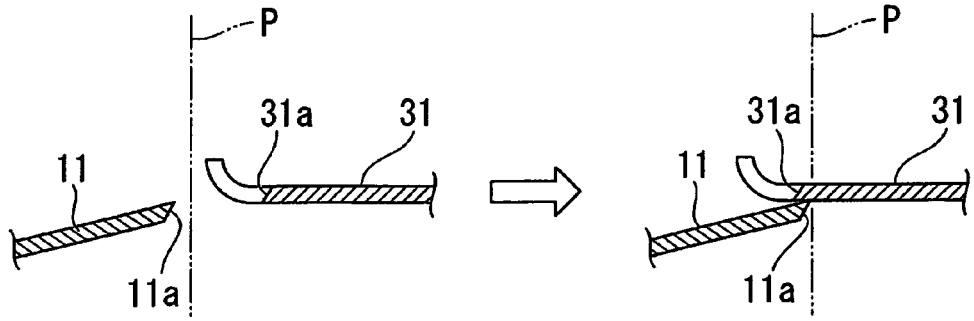
FIG. 11 is a sectional view illustrating movement of the fixed blade and the movable blade during a transition from the state illustrated in FIG. 9 to the state illustrated in FIG. 10.

As illustrated in FIG. 9, the movable blade 31 is a plate-shaped blade having a substantially V-shape in top view formed such that the length from the bottom to a blade edge 31*a* gradually becomes shorter from both ends towards the center. When viewed laterally, the movable blade is formed to be warped in a longitudinal direction (direction indicated by an arrow L) with its center slightly recessed toward the fixed blade 11 (downward). As illustrated in FIGS. 10 and 11, when slid towards the fixed blade 11, the movable blade 31 rides on the upper surface of the fixed blade 11 to thereby hold and cut the recording sheet P with the fixed blade 11. When the movable blade 31 is slid, the fixed blade 11 is pushed down towards the platen roller 10 by the movable blade 31. However, the fixed blade 11 is biased upward by the torsion spring 16, and hence the blades 11, 31 come in contact with each other at an appropriate contact pressure, as illustrated in FIG. 11.

In particular, the movable blade 31 is slightly warped in a longitudinal direction as described above. Therefore, at the time of sliding, the blade edge 31*a* of the movable blade 31 and the blade edge 11*a* of the fixed blade 11 come not into surface contact but into point contact at two points. Then, as the movable blade 31 is further slid, the two points of the point contact gradually move from both ends of the movable blade 31 toward its center. Therefore, the recording sheet P can be sharply cut.

Moreover, the gear transmission mechanism (not shown), which meshes with the driven gear 10*c* fixed to the shaft body 10*a* of the platen roller 10 when the opening/closing door 6 is closed, and the motor (not shown) for rotating the driven gear 10*c* through the gear transmission mechanism are incorporated into the main body unit 4.

Further, a control board (not shown), which includes various electronic devices mounted thereon, is provided in the main body unit 4, and outputs an electric signal or a control signal to the thermal head 30 and a control signal to the motor for driving the platen roller 10 and the movable blade 31 to perform overall control of the components.

Next, the operation of the thermal printer 1 configured as above is described.

First, as illustrated in FIGS. 1 and 2, the paper roll R is thrown in the casing 2 from the insertion port 2*a* with the opening/closing door 6 being opened. In this case, the recording sheet P is pulled out by a length of a certain extent to the outer side of the casing 2 in advance. The opening/closing door 6 is closed and the opening/closing door 6 is locked by the lock mechanism with the pulled out recording sheet P being pulled out to the outer side of the casing 2. Thus, as illustrated in FIG. 3, the recording sheet P is held between the platen roller 10 and the thermal head 30, and is pulled out to the outer side of the casing 2 from the discharge port 2*c*.

After setting the paper roll R as described above, various information is printed on the recording sheet P.

First, the motor is operated by the control board through the gear transmission mechanism, thereby rotating the platen roller 10. The recording sheet P held between the outer peripheral surface of the platen roller 10 and the thermal head 30 is thereby fed to the upper side of the casing 2, and the paper roll R placed on the placement table 2*b* rotates. The thermal head 30 is operated at the same time through the control board. A great number of heater elements then appropriately emit heat. Various characters, figures, and the like then can be clearly printed on the fed recording sheet P. Thereafter, the recording sheet P further fed by the platen roller 10 passes between the fixed blade 11 and the movable blade 31.

Next, when the printing is terminated to cut the recording sheet P, the slide portion 32 is operated through the control board to slide the movable blade 31. As illustrated in FIG. 11, the movable blade 31 rides on the upper surface 12*a* of the fixed blade 11, and hence the respective blade edges 11*a*, 31*a* overlap. The recording sheet P then can be held and cut between the fixed blade 11 and the movable blade 31. As a result, the recording sheet P wounded to the paper roll R can be used as a receipt, a ticket, and the like.

Incidentally, the fixed blade 11 is configured such that the blade edge 11*a* can rock in a direction substantially orthogonal to the sliding direction of the movable blade 31 through the fixed blade holder 12. Further, the fixed blade 11 is biased such that the blade edge 11*a* side is constantly lifted up by the torsion spring 16 through the fixed blade holder 12. Thus, when the movable blade 31 rides on the upper surface 12*a* of the fixed blade 11 by the sliding operation, the fixed blade 11 is brought into contact with the movable blade 31 at an appropriate contact pressure. Therefore, when cutting the recording sheet P, the fixed blade 11 and the movable blade 31 rub against each other with such contact pressure. The recording sheet P thus can be cut sharply without forming a gap between the blade edge 11*a* of the fixed blade 11 and the blade edge 31*a* of the movable blade 31.

In addition, because the movable blade 31 is slightly warped in the longitudinal direction, the blade edge 11*a* of the fixed blade 11 and the blade edge 31*a* of the movable blade 31 can be brought into point contact with each other. Therefore, the recording sheet P can be sharply cut as if a pair of scissors is used. By this operation, the recording sheet P can be cut with good sharpness.

Moreover, the fixed blade 11 is fixed by the fixed blade holder 12 while being provided adjacent to the platen roller 10. Therefore, the cutting position for cutting the recording sheet P can be brought as close as possible to the center of the platen roller 10. Therefore, the printing can be performed while eliminating an unprinted area as much as possible. Thus, a cut piece of the recording sheet P can be prevented from being unnecessarily long. In addition, the consumption of paper is kept down thereby allowing for efficient use of the paper roll R.

Moreover, the fixed blade holder 12 and the fixed blade 11 are provided in the vicinity of the platen roller 10 as described above to constitute the same unit (platen unit 3). Moreover, similarly to the fixed blade holder 12, the fixed blade bracket 13 is also provided in the vicinity of the platen roller 10. Therefore, a configuration is such that the components are gathered to be provided as close as possible to the platen roller 10. Thus, in contrast to the conventional printer including the platen roller 10, the fixed blade 11, and the movable blade 31 respectively as different units, the entity can be compactly configured, resulting in the reduction in size.

Next, the case where the recording sheet P being fed by the platen roller 10 enters into the gap between the fixed blade holder 12 and the platen roller 10 for some reason during a printing operation is described.

Figure 12:
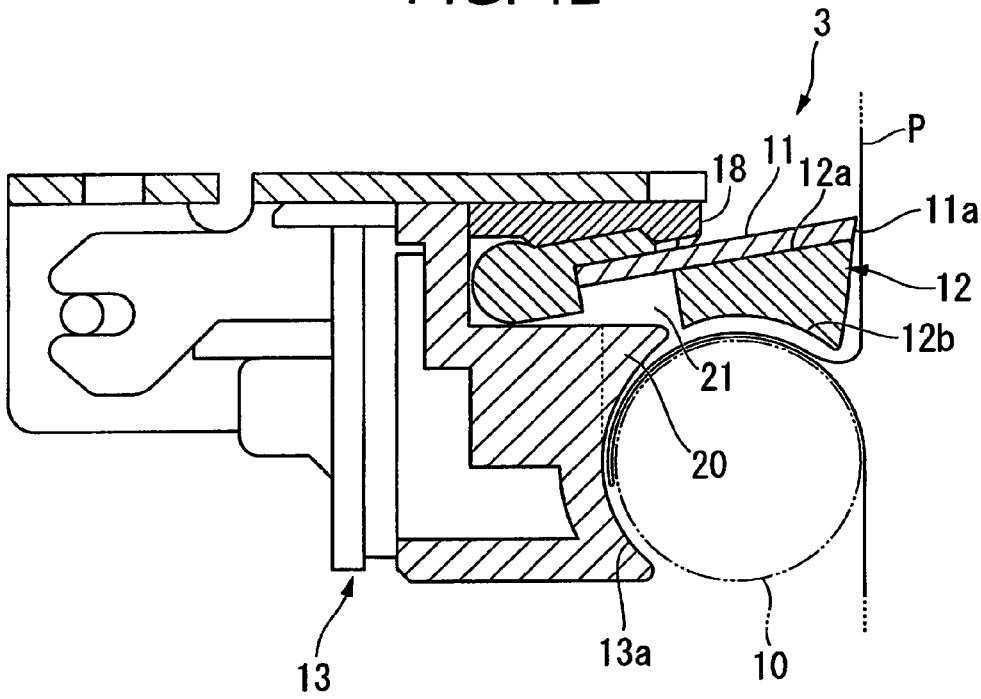
FIG. 12 is a view illustrating a state where the recording sheet gets into a gap between a fixed blade holder and the platen roller during the printing from a point of view illustrated in FIG. 7.

When the recording sheet P gets into the gap between the fixed blade holder 12 and the platen roller 10 during the printing, the recording sheet P is moved toward the bottom of the fixed blade holder 12 by the rotation of the platen roller 10, as illustrated in FIG. 12. However, because the lower surface 12*b* of the fixed blade holder 12 according to this embodiment is formed to be curved along the outer peripheral surface of the platen roller 10, the recording sheet P is smoothly guided along the lower surface 12*b* without being jammed during the movement to automatically start moving toward the downstream side in the rotating direction of the platen roller 10. Then, the recording sheet P is transferred to the guide tables 20 during the movement. Then, the transferred recording sheet P is guided toward the downstream side in the rotating direction of the platen roller 10 while moving on the guide tables 20 in a sliding manner to move into the gap between the opposed surface 13*a* of the fixed blade bracket 13 and the platen roller 10.

Figure 13:
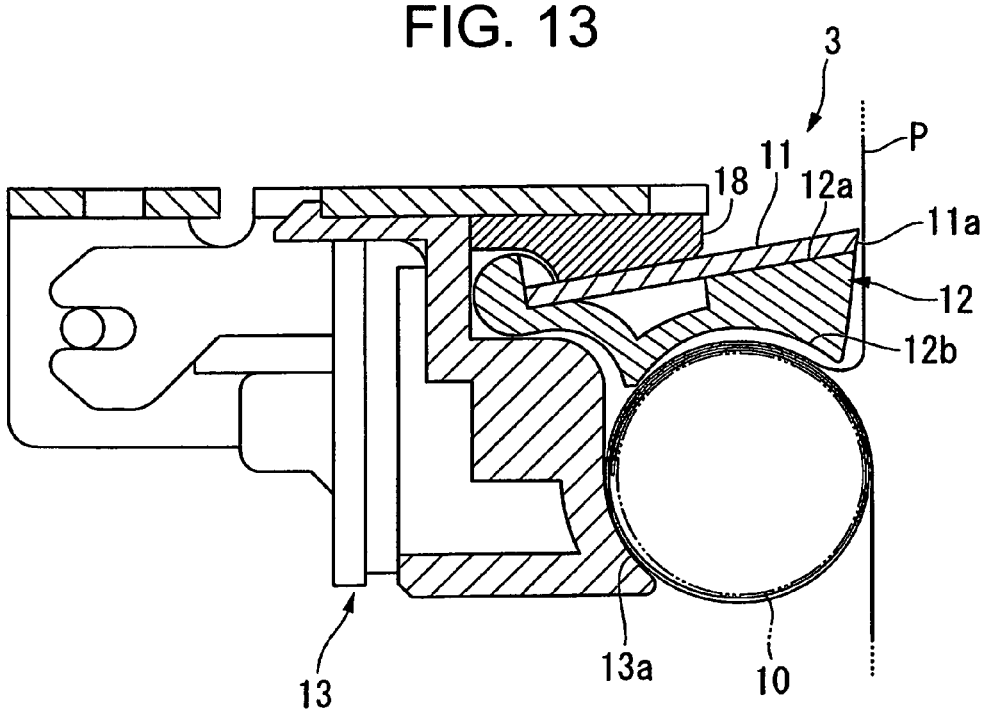
FIG. 13 is a view illustrating a state where the recording sheet further travels toward downstream in a rotating direction of the platen roller from the state illustrated in FIG. 12 to be wound around the platen roller, from a point of view illustrated in FIG. 8.

The opposed surface 13*a* of the fixed blade bracket 13 is also curved along the outer peripheral surface of the platen roller 10 as in the case of the lower surface 12*b* of the fixed blade holder 12. Therefore, the opposed surface 13*a* of the fixed blade bracket 13 guides the recording sheet P to allow the recording sheet to be wound around the platen roller 10 when the recording sheet P is guided from the fixed blade holder 12 side. Therefore, as illustrated in FIG. 13, the recording sheet P can be automatically wound around the platen roller 10. In particular, because the opposed surface 13*a* of the fixed blade bracket 13 is curved at substantially the same curvature as that of the platen roller 10, the recording sheet P can be surely and easily wound around the platen roller 10.

As described above, even when the recording sheet P gets into the gap between the fixed blade holder 12 and the platen roller 10 during the printing, there is a low risk that the recording sheet P is jammed during the movement to be folded into several layers or into an accordion shape, in contrast to the conventional cases. Therefore, even if the paper jam occurs, the platen roller 10 can be spun to pull out the recording sheet P just by opening the opening/closing door 6 to pull the recording sheet P. Therefore, a recovery operation can be easily performed. In addition, because the recording sheet P can be pulled out in a good condition, the recoding sheet P can be reused without being wasted, thereby providing excellent economic efficiency.

In particular, because the recording sheet P is wound around the platen roller 10, the recording sheet P is hardly folded or wrinkled. Therefore, for the recovery, the recording sheet P can be pulled out in a better condition in comparison with the case where the present invention is not applied.

In addition, the recording sheet P getting into the gap between the fixed blade holder 12 and the platen roller 10 is guided toward the downstream side in the rotating direction of the platen roller 10 by using the guide tables 20. Therefore, even if the level difference is generated at the boundary between the lower surface 12*b* of the fixed blade holder 12 and the opposed surface 13*a* of the fixed blade bracket 13, the recording sheet P can be moved without being affected by the level difference. Therefore, the recording sheet P can be more smoothly moved to be prevented from being jammed by the effects of the level difference.

As described above, according to the thermal printer 1 of this embodiment, the thermal printer has a compact structure to allow for its reduction in size, and in addition, is capable of performing a printing operation while eliminating the occurence of an unprinted area as much as possible. Moreover, even if a paper jam occurs during a printing operation, the sheet recovery operation can be easily performed. Further, the recording sheet P can be reused without being wasted.

The technical scope of the present invention is not limited to the above-mentioned embodiment, and various modifications may be made without departing from the gist of the present invention.

For instance, in the embodiment described above, the thermal printer 1 has been described as one example of the printer with a cutter, but the invention is not limited to the thermal printer 1. For instance, the printer may be an inkjet printer, having the print head as the inkjet head, for printing on the pulled out recording sheet P using ink droplets.

While the thermal printer 1 having the opening/closing door 6 on the upper surface 12*a* of the casing 2 has been described, the design may be made such that the opening/closing door 6 is arranged to the front surface of the casing 2, and hence the printed recording sheet P is discharged from the front surface side. Further, in the embodiment described above, a drop-in type thermal printer 1 of simply throwing the paper roll R and mounting it on the placement table 2*b* has been described, but it is not limited to such type, and may be an axial-supporting type thermal printer in which an axially supporting mechanism for axially supporting (rotatably supporting) the paper roll R is arranged inside the casing 2.

In the above-mentioned embodiment, even the opposed surface 13*a* of the fixed blade bracket 13 is formed to be curved. However, it is sufficient that at least the lower surface 12*b* of the fixed blade holder 12 is curved. Even in this case, if the recording sheet P gets into the gap between the fixed blade holder 12 and the platen roller 10, the recording sheet P can be automatically guided toward the downstream side in the rotating direction of the platen roller 10 without being folded into several layers or folded into an accordion shape during the movement. Therefore, the same effects can be produced.

In this case, it is sufficient that the position for housing the paper roll R, a path-through which the recording sheet P pulled out from the paper roll R passes, or the like is changed to ensure a space below the fixed blade bracket 13 to thereby guide the recording sheet P, which is guided from the fixed blade holder 12 side into the gap between the fixed blade bracket 13 and the platen roller 10, into the space.

Figure 14:
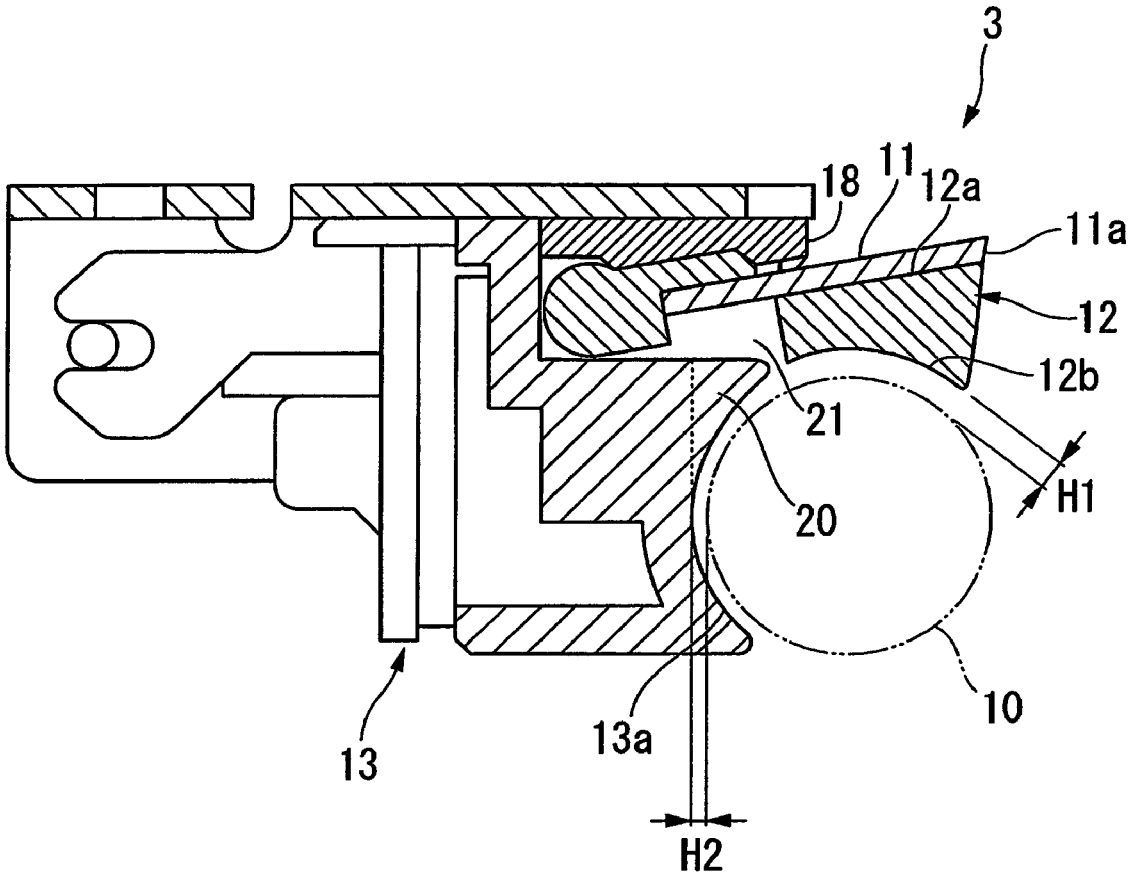
FIG. 14 is a view illustrating a variation of the printer with a cutter according to the present invention, for illustrating a relation between the gap between the fixed blade holder and the platen roller and a gap between a fixed blade bracket and the platen roller.
Figure 15:
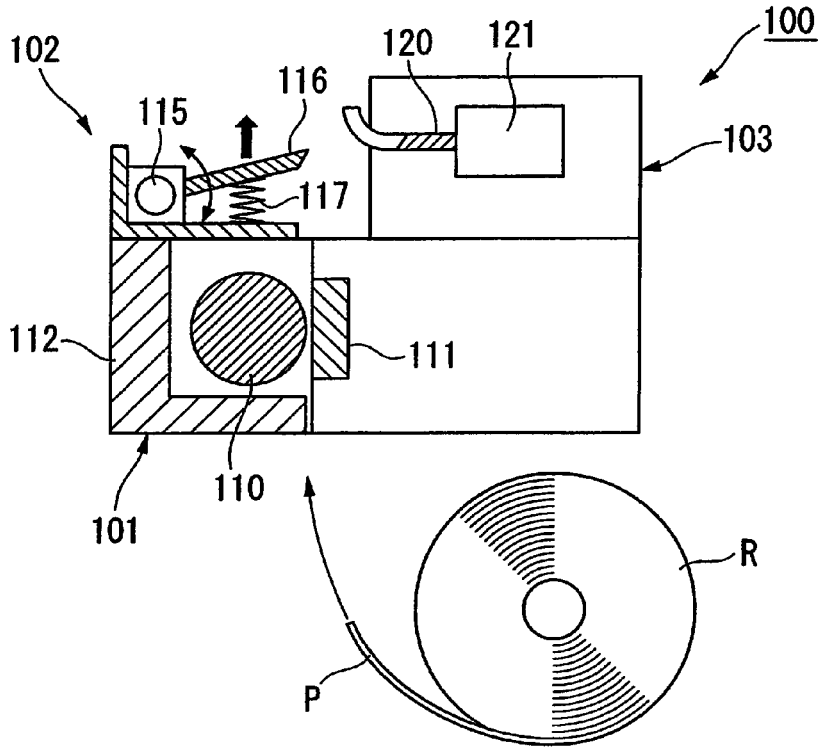
FIG. 15 PRIOR ART
FIG. 15 is a view illustrating an example of a conventional thermal printer.
Figure 16:
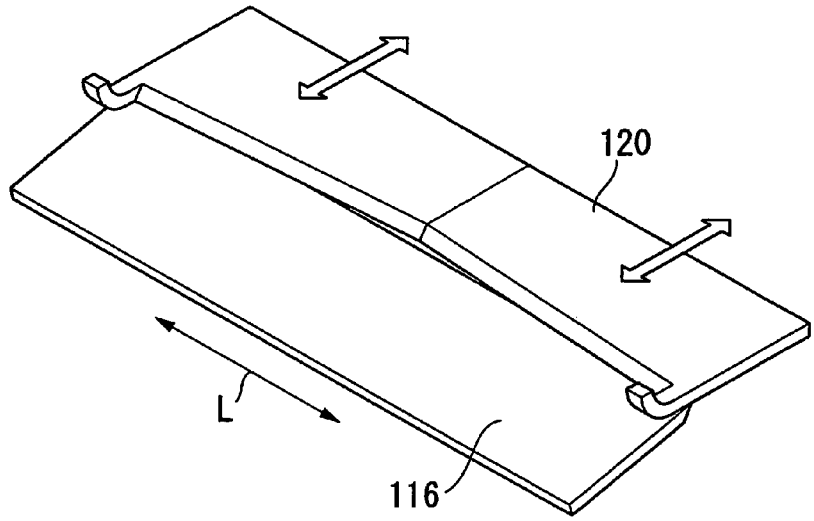
FIG. 16 PRIOR ART
FIG. 16 is a view illustrating a positional relation between the fixed blade and the movable blade of the thermal printer illustrated in FIG. 15.
Figure 17:
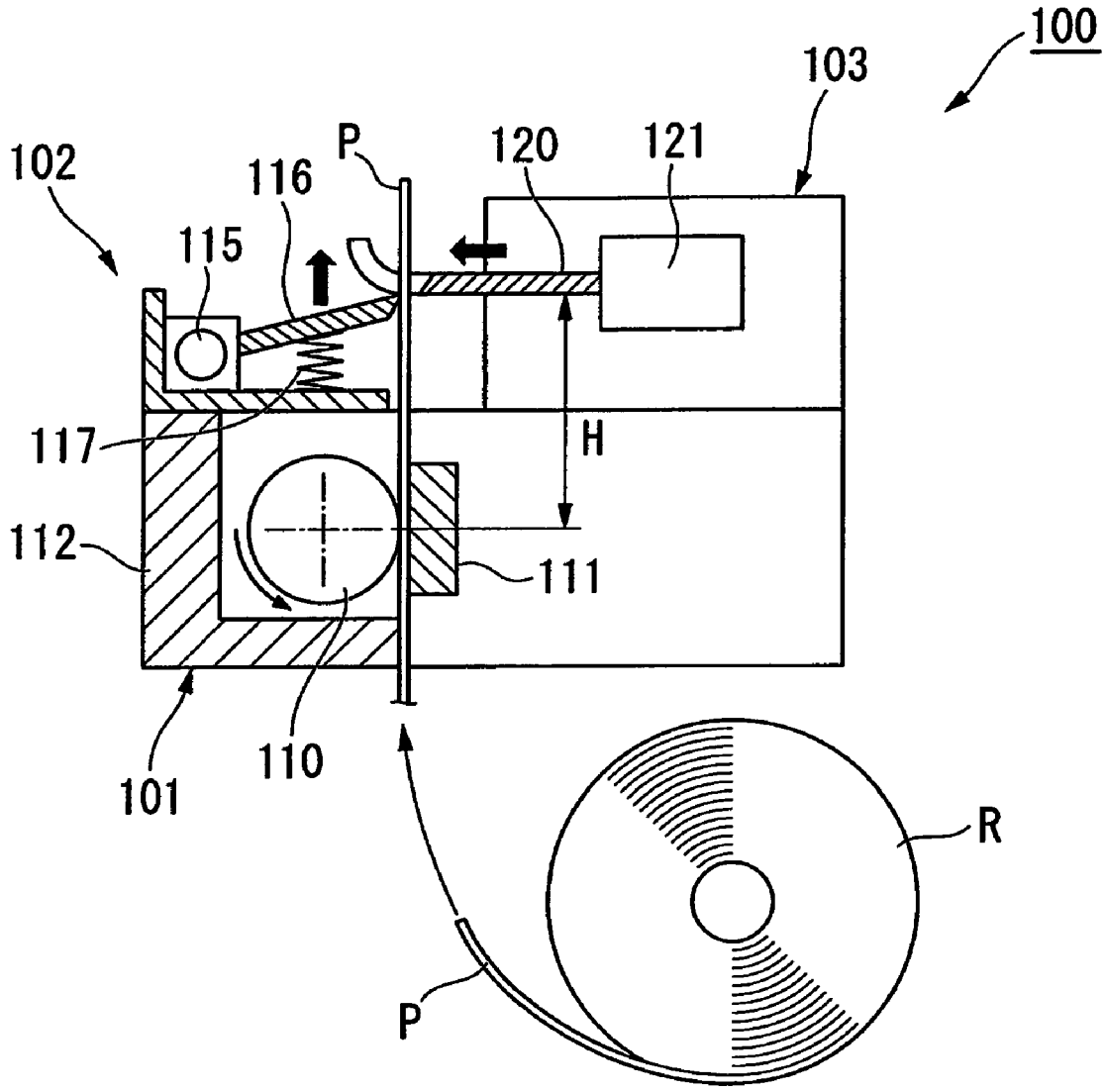
FIG. 17 PRIOR ART
FIG. 17 is a view illustrating a state where the printing is performed on the recording sheet by the thermal printer illustrated in FIG. 15.
Figure 18:
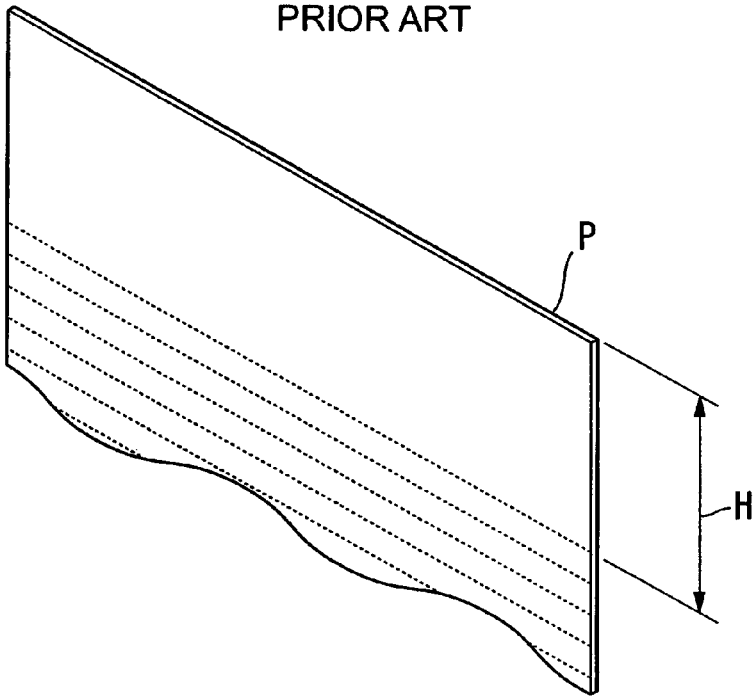
FIG. 18 PRIOR ART
FIG. 18 is a view illustrating a part of the recording sheet on which the printing is performed by the thermal printer illustrated in FIG. 15.
Figure 19:
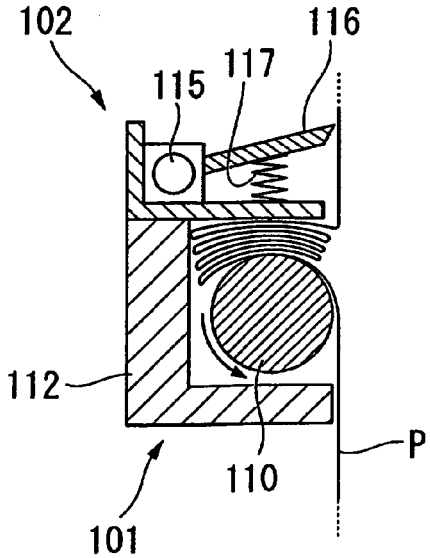
FIG. 19 PRIOR ART
FIG. 19 is a view illustrating a state where the recording sheet is caught by the platen roller to be folded into several layers during the printing.

Moreover, in the above-mentioned embodiment, it is preferred to design a gap H1 between the lower surface 12*b* of the fixed blade holder 12 and the outer peripheral surface of the platen roller 10 when the fixed blade holder 12 is pushed up by the torsion spring 16 to be greater than a gap H2 between the opposed surface 13*a* of the fixed blade bracket 13 and the outer peripheral surface of the platen roller 10, as illustrated in FIG. 14.

In this manner, when the recording sheet P is wound around the platen roller 10 to increase the diameter of the platen roller 10, the gap H2 between the opposed surface 13*a* of the fixed blade bracket 13 and the outer peripheral surface of the platen roller 10 is first eliminated. Therefore, the platen roller 10 is affected by the elimination of the gap to stop rotating. In this case, because the gap H1 is greater than the gap H2 as the relation between the two gaps H1 and H2 as described above, the fixed blade holder 12 is rockable by the amount of a difference between the gaps H1 and H2. Specifically, even when the diameter is excessively increased by the winding of the recording sheet P to stop the rotation of the platen roller 10, the blade edge 11*a* side of the fixed blade 11 can be still pressed down.

Thus, it is possible to slide the movable blade 31 to cut the recording sheet P with the fixed blade 11 and the movable blade 31. Therefore, even if the platen roller 10 is stopped, the recording sheet P can be cut to perform a quick recovery operation. Because the rocking operation of the fixed blade 11 can be ensured as described above, the reliability of the recovery operation can be enhanced. Further, an excessive contact pressure can be prevented from acting between the fixed blade 11 and the movable blade 31 at the time of cutting. Thus, an inconvenience such as the blocked movement of the inter-meshing blades 11 and 31 which become stuck or the resulting damages thereof can be prevented from occurring.

What is claimed is:

1. A printer with a cutter for cutting a recording sheet pulled out from a paper roll after printing is performed on the recording sheet, comprising:

a print head extending in a width direction of the recording sheet;

a platen roller having an outer peripheral surface contactable with the print head with the recording sheet being interposed therebetween, the platen roller being mounted to undergo rotation in a rotating direction to feed the recording sheet;

a fixed blade disposed adjacent to the platen roller so as to be opposed to the fed recording sheet;

a movable blade mounted to undergo sliding movement toward the fixed blade for cutting the recording sheet after printing is performed on the recording sheet;

a fixed blade holder disposed between the fixed blade and the platen roller, the fixed blade holder having one surface on which the fixed blade is fixedly supported and another surface opposed to the outer peripheral surface of the platen roller with a gap therebetween, the another surface of the fixed blade holder being curved along the outer peripheral surface of the platen roller and being configured to guide the recording sheet toward a downstream side of the fixed blade holder in the rotating direction of the platen roller when the recording sheet enters the gap between the fixed blade holder and the platen roller;

a holder support having a surface opposed to the outer peripheral surface of the platen roller on the downstream side of the fixed blade holder in the rotating direction of the platen roller with a gap therebetween, the holder support being configured for pivotally supporting the fixed blade holder to allow a blade edge side of the fixed blade to be moved in a direction substantially orthogonal to a sliding direction of the movable blade; and a biasing member disposed between the fixed blade holder and the holder support for biasing the fixed blade holder in a direction away from the peripheral surface of the platen roller.

2. A printer with a cutter according to claim 1; wherein the surface of the holder support opposed to the outer peripheral surface of the platen roller is curved along the outer peripheral surface of the platen roller and guides the recording sheet to allow the recording sheet to be wound around the platen roller when the recording sheet is guided by the another surface of the fixed blade holder.

3. A printer with a cutter according to claim 2; wherein the surface of the holder support is curved at substantially the same curvature as a curvature of the platen roller.

4. A printer with a cutter according to claim 2; wherein the gap between the another surface of the fixed blade holder and the outer peripheral surface of the platen roller when the fixed blade holder is biased by the biasing member is set larger than the gap between the surface of the holder support and the outer peripheral surface of the platen roller.

5. A printer with a cutter according to claim 1; wherein the gap between the another surface of the fixed blade holder and the outer peripheral surface of the platen roller when the fixed blade holder is biased by the biasing member is set larger than the gap between the surface of the holder support and the outer peripheral surface of the platen roller.

6. A printer with a cutter according to claim 1; further comprising a guide table for receiving the recording sheet entering into the gap between the another surface of the fixed blade holder and the platen roller to guide the recording sheet toward the downstream side of the fixed blade holder in the rotating direction of the platen roller, the guide table being formed on the holder support so as to extend beyond a boundary with the fixed blade holder toward the another surface of the fixed blade holder.

7. A printer with a cutter according to claim 2; further comprising a guide table for receiving the recording sheet entering into the gap between the another surface of the fixed blade holder and the platen roller to guide the recording sheet toward the downstream side of the fixed blade holder in the rotating direction of the platen roller, the guide table being formed on the holder support so as to extend beyond a boundary with the fixed blade holder toward the another surface of the fixed blade holder.

8. A printer with a cutter according to claim 3; further comprising a guide table for receiving the recording sheet entering into the gap between the another surface of the fixed blade holder and the platen roller to guide the recording sheet toward the downstream side of the fixed blade holder in the rotating direction of the platen roller, the guide table being formed on the holder support so as to extend beyond a boundary with the fixed blade holder toward the another surface of the fixed blade holder.

9. A printer with a cutter according to claim 4; further comprising a guide table for receiving the recording sheet entering into the gap between the another surface of the fixed blade holder and the platen roller to guide the recording sheet toward the downstream side of the fixed blade holder in the rotating direction of the platen roller, the guide table being formed on the holder support so as to extend beyond a boundary with the fixed blade holder toward the another surface of the fixed blade holder.

10. A printer with a cutter according to claim 5; further comprising a guide table for receiving the recording sheet entering into the gap between the another surface of the fixed blade holder and the platen roller to guide the recording sheet toward the downstream side of the fixed blade holder in the rotating direction of the platen roller, the guide table being formed on the holder support so as to extend beyond a boundary with the fixed blade holder toward the another surface of the fixed blade holder.

11. A printer with a cutter according to claim 1; wherein the another surface of the fixed blade holder is disposed in confronting relation to the outer peripheral surface of the platen roller.

12. A printer with a cutter according to claim 1; further comprising a first stopper for limiting a movement amount of the fixed blade holder in the direction away from the peripheral surface of the platen roller.

13. A printer with a cutter according to claim 12; further comprising a second stopper for limiting a movement amount of the fixed blade holder in the direction toward the peripheral surface of the platen roller.

14. A printer with a cutter according to claim 1; further comprising means for limiting pivotal movement of the fixed blade holder within a preselected angular range.

15. A printer with a cutter, comprising:

a print head that performs printing on a recording sheet during a printing operation;

a platen roller having an outer peripheral surface supporting the recording sheet adjacent to the print head during a printing operation;

a fixed blade disposed adjacent to the platen roller and having a blade edge configured to be positioned opposite to the recording sheet;

a movable blade mounted to undergo sliding movement toward the fixed blade while the blade edge of the fixed blade is positioned opposite to the recording sheet for cutting the recording sheet after the print head performs printing on a recording sheet during a printing operation;

a fixed blade holder having a first surface supporting the fixed blade thereon and second surface opposite to the first surface and disposed in confronting relation to the outer peripheral surface of the platen roller with a first gap therebetween, the second surface having a curved shape for guiding the recording sheet toward a downstream side of the fixed blade holder in the rotating direction of the platen roller when the recording sheet enters the first gap; and a holder support pivotally supporting the fixed blade holder, the holder support having a surface opposed to the outer peripheral surface of the platen roller with a second gap therebetween for guiding the recording sheet to allow the recording sheet to be wound around the outer peripheral surface of the platen roller when the recording sheet is guided by the second surface of the fixed blade holder.

16. A printer with a cutter according to claim 15; further comprising a biasing member disposed between the fixed blade holder and the holder support for biasing the fixed blade holder in a direction away from the peripheral surface of the platen roller.

17. A printer with a cutter according to claim 16; wherein the first gap is larger than the second gap when the fixed blade holder is biased by the biasing member in the direction away from the peripheral surface of the platen roller.

18. A printer with a cutter according to claim 16; further comprising a first stopper for limiting a movement amount of the fixed blade holder in the direction away from the peripheral surface of the platen roller.

19. A printer with a cutter according to claim 18; further comprising a second stopper for limiting a movement amount of the fixed blade holder in the direction toward the peripheral surface of the platen roller.

20. A printer with a cutter according to claim 15; further comprising means for limiting pivotal movement of the fixed blade holder within a preselected angular range.

* * * * *